US007032838B2

(12) United States Patent
Fan

(10) Patent No.: US 7,032,838 B2
(45) Date of Patent: Apr. 25, 2006

(54) SHOWERHEAD ASSEMBLY

(75) Inventor: Chen-Yueh Fan, Room F/23, 4th Fl., No.5, Sec. 5, Hsinyi Rd., Taipei (TW)

(73) Assignee: Chen-Yueh Fan, Taipei (TW)

( * ) Notice: Subject to any disclaimer, the term of this patent is extended or adjusted under 35 U.S.C. 154(b) by 105 days.

(21) Appl. No.: 10/868,898

(22) Filed: Jun. 17, 2004

(65) Prior Publication Data

US 2005/0279864 A1 Dec. 22, 2005

(51) Int. Cl.
*B05B 7/02* (2006.01)
*B05B 9/01* (2006.01)

(52) U.S. Cl. ..... 239/288.5; 239/289; 239/525; 239/530; 239/600

(58) Field of Classification Search ..... 239/288, 239/288.3, 288.5, 443–449, 525, 530, 532, 239/600, 289; 604/74, 346
See application file for complete search history.

(56) References Cited

U.S. PATENT DOCUMENTS

| | | | | |
|---|---|---|---|---|
| 3,092,334 A * | 6/1963 | Peterson | 239/516 |
| D381,737 S * | 7/1997 | Chan | D23/223 |
| 6,209,807 B1 * | 4/2001 | Hsin-Fa | 239/600 |
| D467,638 S * | 12/2002 | Lord | D23/229 |
| 6,679,438 B1 * | 1/2004 | Didlo | 239/288.5 |

* cited by examiner

*Primary Examiner*—David A. Scherbel
*Assistant Examiner*—Jason Boeckmann
(74) *Attorney, Agent, or Firm*—Fei-Fei Chao; Bingham McCutchen LLP

(57) ABSTRACT

A showerhead assembly includes a cup and a showerhead. The cup is attached to the showerhead to concentrate a stream of water so that a user is able to enjoy a massaging effect when the stream of water impacts the user's body.

7 Claims, 6 Drawing Sheets

SHOWERHEAD ASSEMBLY

BACKGROUND OF THE INVENTION

1. Field of the Invention

The present invention relates to a showerhead assembly, and more particularly to a showerhead assembly with a hollow cup to concentrate a stream of water, which is able to give a massage when the showerhead assembly is being used.

2. Description of Related Art

Most people enjoy a body massage because a body massage helps people relax and shapes their bodies. A massage from a masseuse is very expensive so some people have tried several different ways to enjoy a massage and save money at the same time.

Some people will use a showerhead to get a massage because showerheads are available in virtually every household and are used when people take a shower.

Showerheads can provide a concentrated stream of water. This concentrated stream of water can provide a massage effect. Particularly, some women massage their breasts to make the shape of their breast bigger.

When the stream of water strikes the body, water will splash. The water will splash everywhere including people's eyes, which may be particularly uncomfortable. To keep water from splashing into people's eyes, people won't use a conventional massaging showerhead to get a massage.

To overcome the shortcomings, the present invention provides an improved showerhead with a hollow cup to mitigate the aforementioned problems.

SUMMARY OF THE INVENTION

The primary objective of the present invention is to provide an improved showerhead that keeps water from splashing uncontrollably and provides a massaging effect to a user.

Another objective of the present invention is to provide a hollow cup attached to the showerhead to concentrate the stream of water so a person is able to enjoy the massaging effect when the stream of water strikes the user's body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
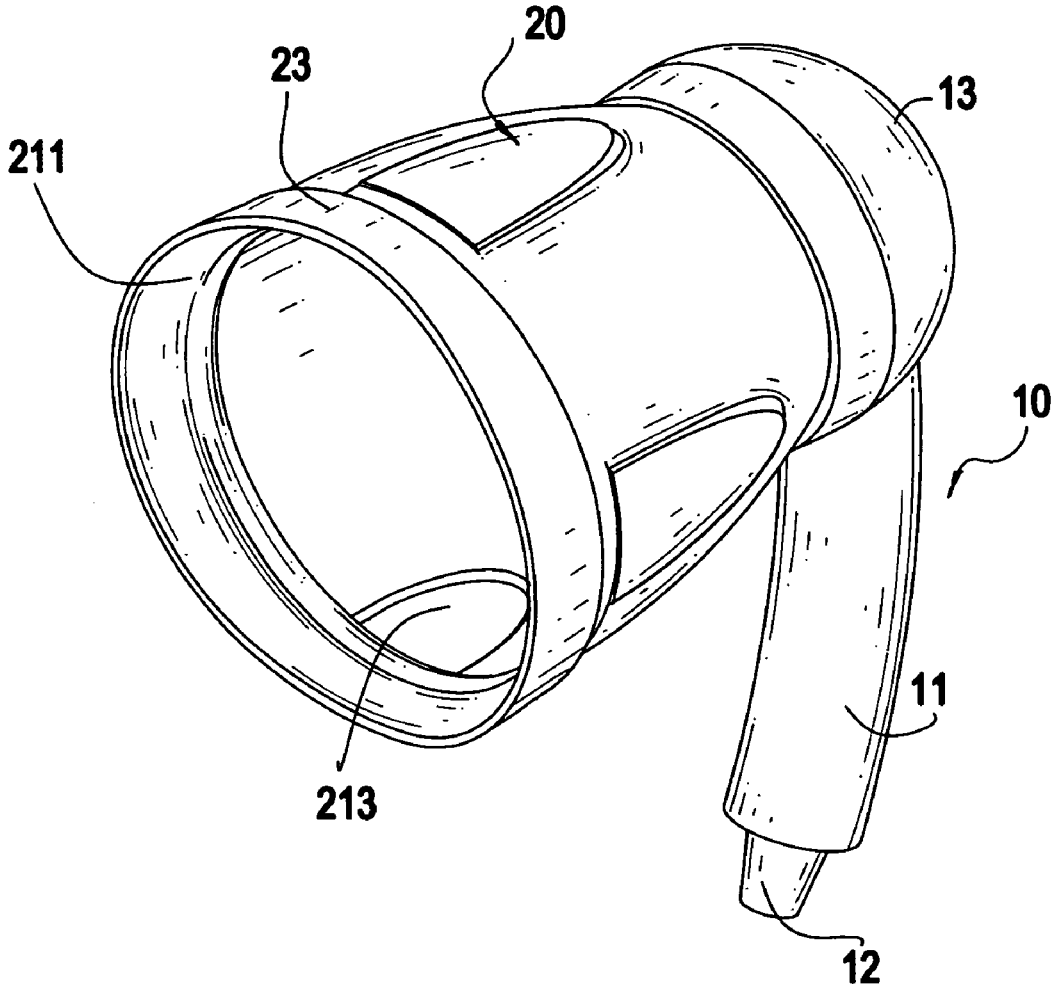
FIG. 1 is a perspective view of a showerhead assembly in accordance with the present invention.

With reference to FIG. 1, a showerhead assembly in accordance with the present invention comprises a showerhead (10) and a hollow cup (20). The hollow cup (20) is selectively connected to the showerhead (10).

Figure 2:
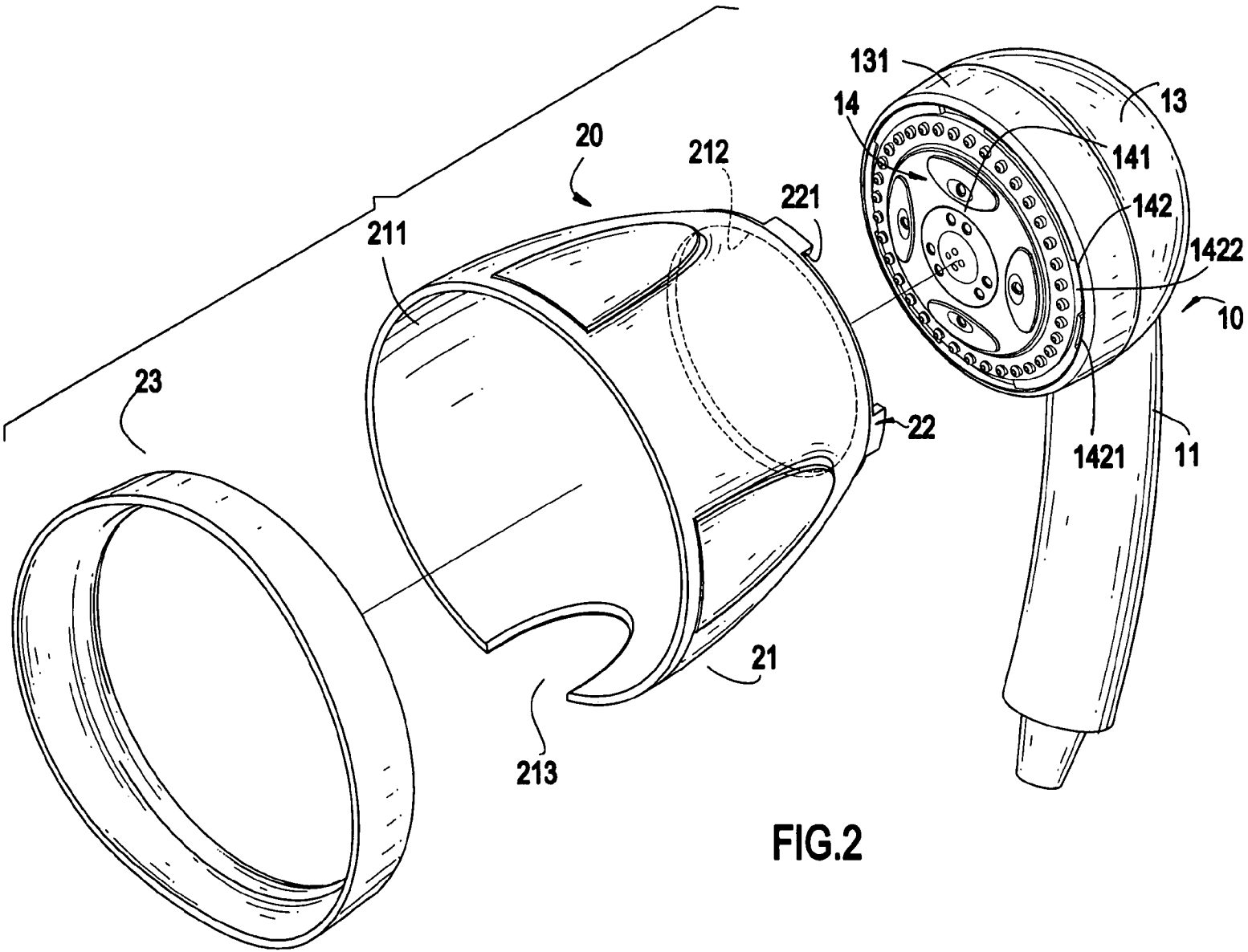
FIG. 2 is a partially exploded perspective view of a first embodiment of the showerhead assembly in accordance with the present invention.
Figure 6:
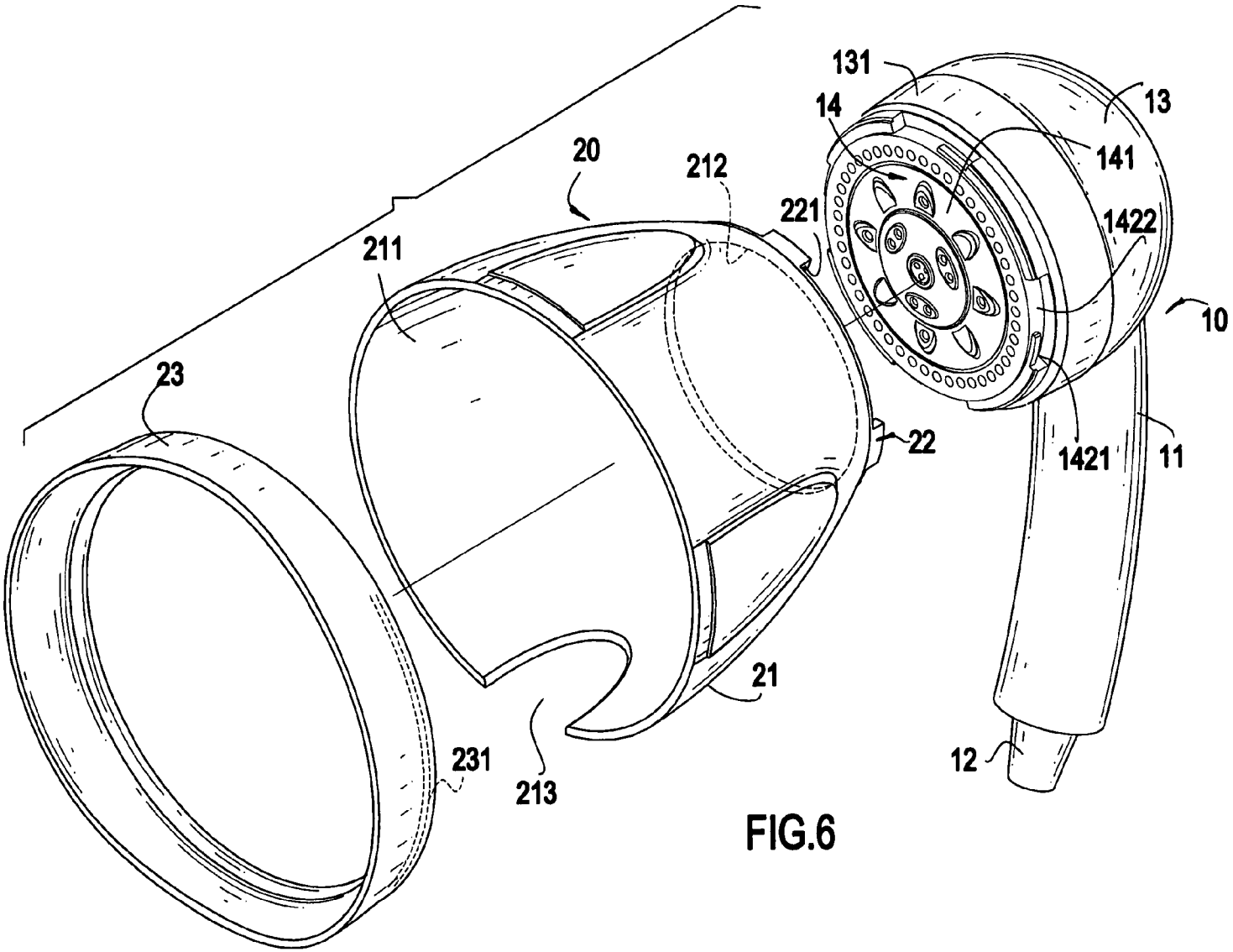
FIG. 6 is a partially exploded perspective view of a second embodiment of the showerhead assembly in accordance with the present invention.

With further reference to FIGS. 2 and 6, the showerhead (10) comprises a sprayhead (13), a handle (11), a hose connector (12) and a nozzle (14).

The sprayhead (13) has a bottom, an opening (132) and a nozzle seat (131). The nozzle seat (131) is an annular mounting band, has a front opening (133) and is mounted around the opening in the sprayhead (13). The nozzle seat (131) may be mounted rotatably around the opening (132) in the sprayhead (13).

The handle (11) has a proximal end and a distal end. The proximal end is attached to the bottom of the sprayhead (13).

The hose connector (12) is mounted on the distal end of the handle (11) and connects the showerhead (10) to an external source of water (not shown)

Figure 3:
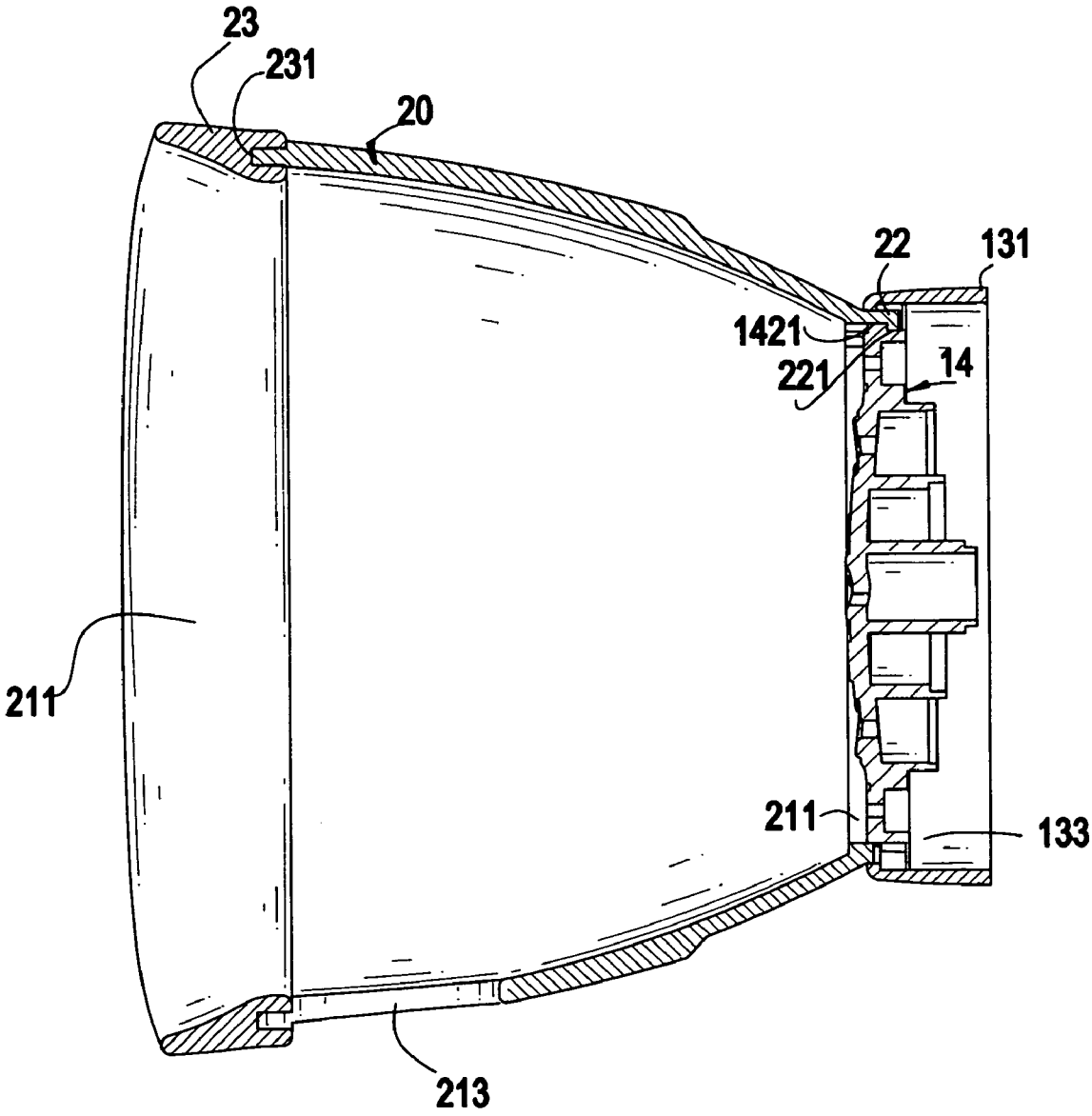
FIG. 3 is a cross sectional side view of the showerhead assembly in FIG. 2.

With further reference to FIG. 3, the nozzle (14) is mounted securely in the nozzle seat (131) and has a face (141), an outer edge and multiple cup connectors.

Figure 4:
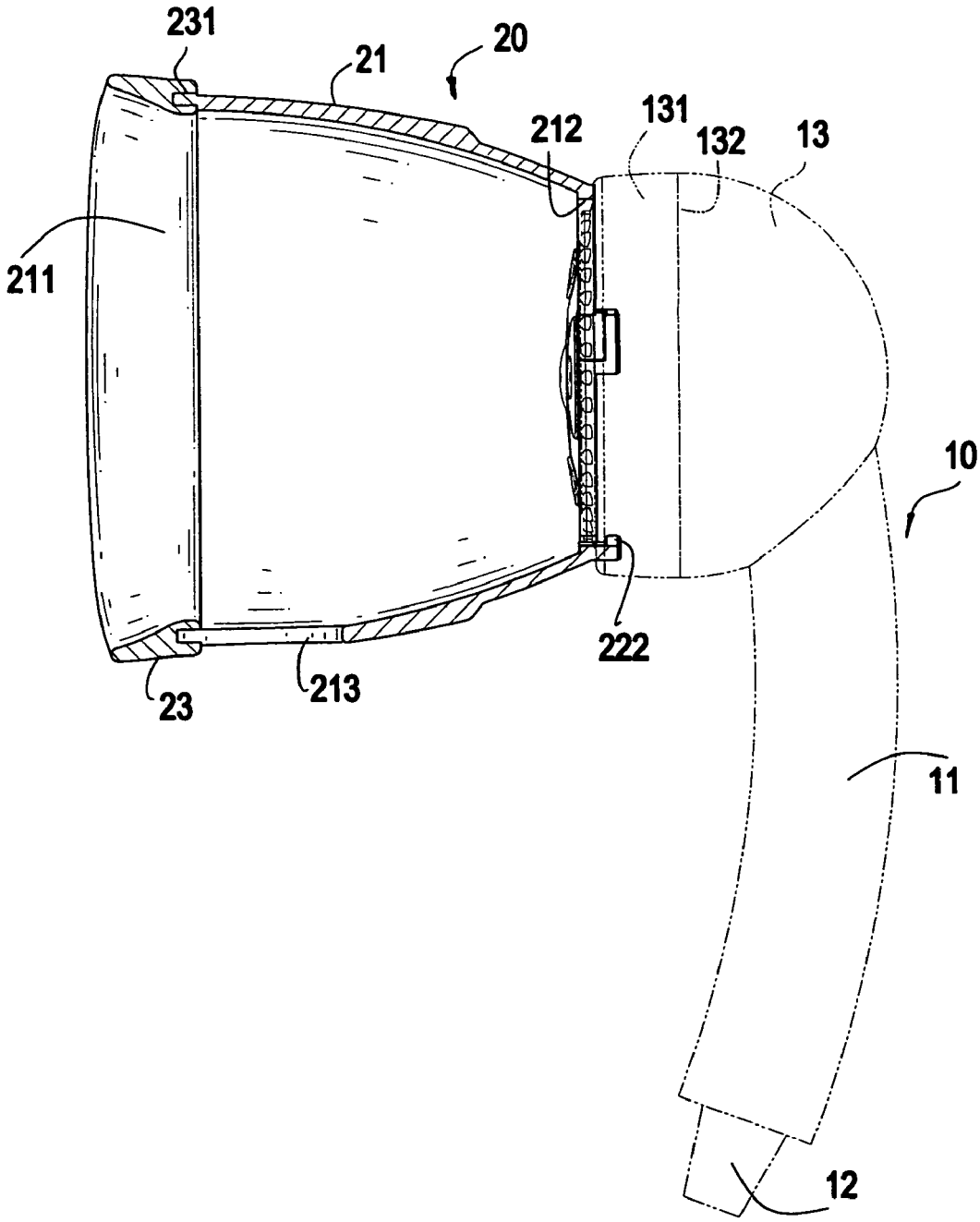
FIG. 4 is a side view in partial section of the showerhead assembly in FIG. 2.

The multiple cup connectors are formed on the outer edge of the nozzle and may be any of a number of conventional connector techniques. With further reference to FIG. 4 and 6, a first embodiment of a cup connector (142) in accordance with the present invention is implemented with an annular groove (1421) and a longitudinal slot (1422). The annular groove (1421) has two ends and is formed in the outer edge of the nozzle (14). The longitudinal slot (1422) is formed in the outer edge of the nozzle (14) at one end of the annular groove (1421) from the face (141) to the annular groove (1421). A second embodiment of the cup connectors in accordance with the present invention is multiple detents formed on the outer edge of the nozzle (14).

The hollow cup (20) comprises a bell-shaped body (21), multiple nozzle connectors and an optional annular edge cushion (23).

The bell-shaped body (21) has an annular sidewall, a front opening (211), a front edge, a rear opening (212), a rear edge and an optional drain (213). The annular sidewall has a bottom (not numbered). The drain (213) is formed through the bottom of the sidewall.

The nozzle connectors are formed on and protrude from the rear edge of the bell-shaped body (21), correspond to the cup connectors on the outer edge of the nozzle (14) and are selectively connected respectively to the cup connectors on the nozzle (14).

A first embodiment of the nozzle connectors (22) is used with the first embodiment of the cup connectors (142), and each nozzle connector (22) has a longitudinal ear (221) and a lip (222). The longitudinal ear (221) protrudes from the rear edge of the bell-shaped body (21) and has a distal end. The lip (222) is formed at and protrudes radically inward from the distal end of the ear (221). The lips (222) correspond respectively to the longitudinal slots (1422) in the cup connector (142), selectively slide respectively into the longitudinal slots (1422) and are rotated respectively into the annular grooves (1421) to hold the hollow cup (20) on the showerhead (10).

A second embodiment of the nozzle connectors in accordance with the present invention are used with the second embodiment of the cup connectors and comprise conventional ball-spring combinations. The ball-spring combinations are mounted inwardly in the rear edge of the bell-shaped body (21) and selectively engage the detent in the second embodiment of the cup connector to hold the hollow cup (20) on the showerhead (10).

The annular edge cushion (23) has a rear edge and an annular groove (231). The rear edge corresponds to the front edge of the bell-shaped body (21). The annular groove (231) is formed longitudinally in the rear edge and is mounted on the front edge of the bell-shaped body (21) around the front opening (211).

Figure 5:
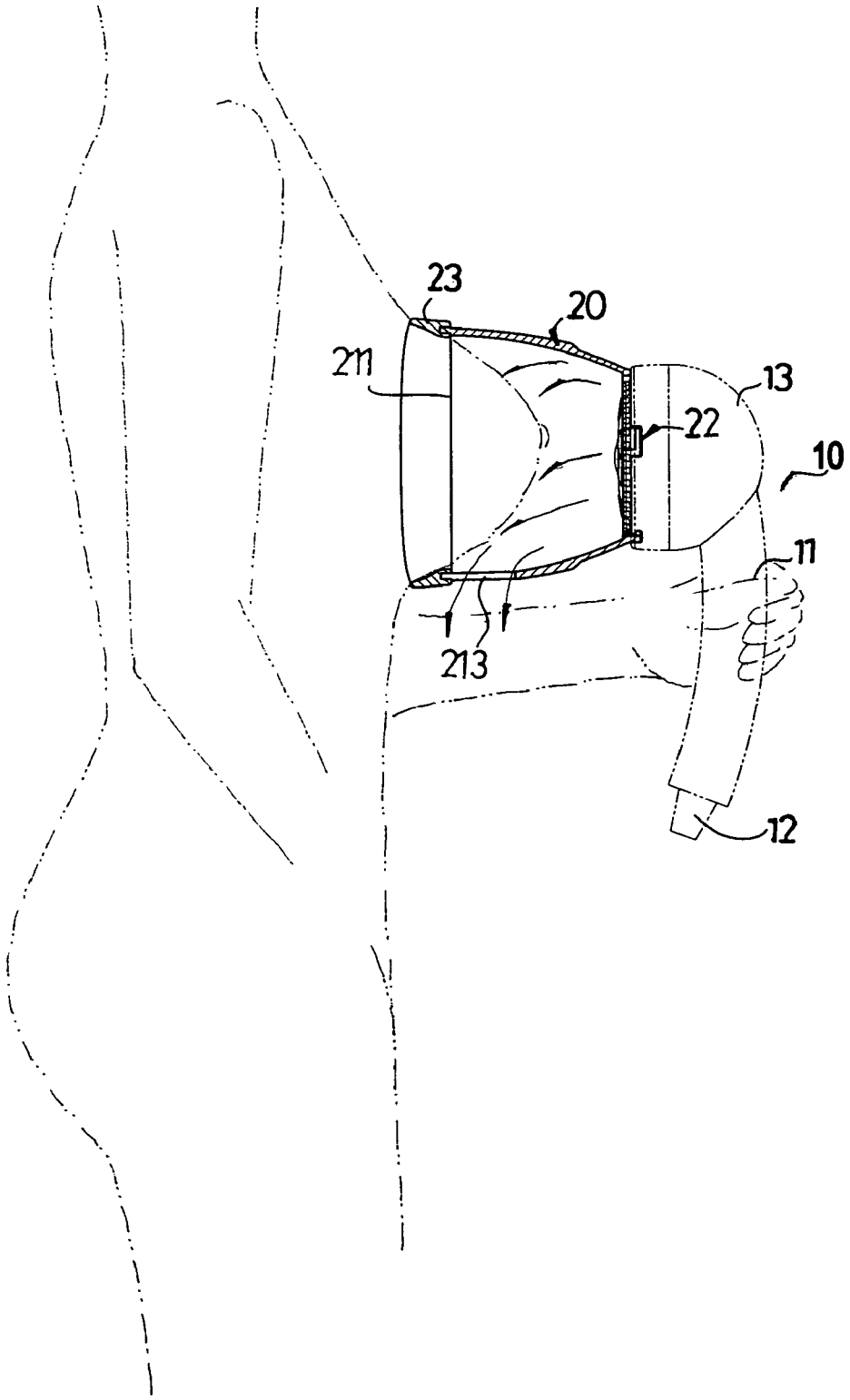
FIG. 5 is an operational side view in partial section of the showerhead assembly in FIG. 2 used to massage a woman's breast.

With reference to FIG. 5, the showerhead assembly is assembled by attaching the hollow cup (20) to the showerhead (10). After turning on the external water source and adjusting the temperature of the water, the hollow cup (20) is pressed against a desired part of the body to be massaged and the annular edge cushion (23) forms a seal between the bell-shaped body (21) and the person's body. The sidewall of the bell-shaped body (21) prevents the water from splashing, and the expended water is discharged through the drain (213).

With reference to FIG. 2 to 5, a first embodiment of the showerhead assembly in accordance with the present invention has the face (141) of the nozzle (14) mounted flush with the opening in the nozzle seat (131).

With reference to FIG. 6, a second embodiment of the showerhead assembly in accordance with the present invention has the face (141) of the nozzle (14) protruding from the opening in the nozzle seat (131).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A showerhead assembly comprising:

a showerhead having:

a sprayhead having a bottom;

an opening; and a nozzle seat being an annular mounting band, having a front opening and mounted around the opening in the sprayhead;

a handle having a proximal end attached to the bottom of the sprayhead; and a distal end;

a hose connector mounted on the distal end of the handle;

a nozzle securely mounted in the nozzle seat and having a face;

an outer edge; and multiple cup connectors formed on the outer edge; and a hollow cup detachably attached to the showerhead and having:

a bell-shaped body having an annular sidewall with a bottom;

a front opening;

a front edge;

a rear opening; and a rear edge; and multiple nozzle connectors formed on and protruding from the rear edge of the bell-shaped body, corresponding to the cup connectors on the outer edge of the nozzle and selectively connected respectively to the cup connectors.

2. The showerhead assembly as claimed in claim 1, wherein the nozzle seat is mounted rotatably around the opening in the sprayhead.

3. The showerhead assembly as claimed in claim 1, wherein each cup connector comprises an annular groove formed in the outer edge of the nozzle and having two ends; and a longitudinal slot formed in the outer edge of the nozzle at one end of the annular groove from the face of the nozzle to the annular groove; and each nozzle connector comprises a longitudinal ear protruding from the rear edge of the bell-shaped body and having a distal end; and a lip formed at and protruding radially inward from the distal end of the longitudinal ear and corresponding to the longitudinal slot in a corresponding one of the cup connectors.

4. The showerhead assembly as claimed in claim 1, wherein the bell-shaped body of the hollow cup has a drain formed in the bottom of the sidewall.

5. The showerhead assembly as claimed in claim 1, wherein the hollow cup has an annular edge cushion having a rear edge; and an annular groove formed longitudinally in the rear edge and mounted on the front edge of the bell-shaped body around the front opening.

6. The showerhead assembly as claimed in claim 1, wherein the face of the nozzle is flush with the opening in the nozzle seat.

7. The showerhead assembly as claimed in claim 1, wherein the face of the nozzle protrudes from the opening in the nozzle seat.

* * * * *